US005924961A

United States Patent [19]

Kuo et al.

[11] Patent Number: 5,924,961

[45] Date of Patent: Jul. 20, 1999

[54] EXERCISE DEVICE FOR BUILDING MUSCLES OF WAIST AND LEGS

[76] Inventors: Johnson Kuo, 11 Fl-1, No. 342, Keelung Rd., Sec. 1, Taipei; Chin-Lien Huang, 2F, No. 14, Ning Hsia E. 5 St., Taichung, both of Taiwan

[21] Appl. No.: 09/086,711

[22] Filed: May 29, 1998

[51] Int. Cl.[6] ..... A63B 22/04

[52] U.S. Cl. ..... 482/52; 482/51; 482/57

[58] Field of Search ..... 482/51, 52, 57, 482/62, 53, 147, 79, 80, 111

[56] References Cited

U.S. PATENT DOCUMENTS

| | | | |
|---|---|---|---|
| 4,555,109 | 11/1985 | Hartmann | 482/62 |
| 5,453,065 | 9/1995 | Lien et al. | 482/52 |
| 5,527,253 | 6/1996 | Wilkinson | 482/52 |
| 5,545,111 | 8/1996 | Wang et al. | 482/53 |
| 5,628,709 | 5/1997 | Chen | 482/53 |
| 5,645,512 | 7/1997 | Yu | 482/53 |
| 5,749,809 | 5/1998 | Lin | 482/52 |
| 5,800,313 | 9/1998 | Yu | 482/53 |

*Primary Examiner*—Jerome W. Donnelly
*Attorney, Agent, or Firm*—Browdy and Neimark

[57] ABSTRACT

An exercise device is designed for developing muscles of waist and legs and is composed of a base, an upright support mounted on the base, a grip unit rotatably mounted on the upright support, two treading members fastened pivotally with the upright support and linked with the grip unit by a transmission mechanism, two damping members connected with the treading members and the base, and a support unit mounted on the upright support such that the support unit is corresponding in location to the grip unit.

11 Claims, 5 Drawing Sheets

EXERCISE DEVICE FOR BUILDING MUSCLES OF WAIST AND LEGS

FIELD OF THE INVENTION

The present invention relates generally to an exercise device, and more particularly to an exercise device for building muscles of waist and legs.

BACKGROUND OF THE INVENTION

The conventional exercise devices for building the muscles of waist and legs are generally devoid of a damping device and are therefore not effective in building the body muscles of a user of the devices. In addition, such exercise devices as mentioned above are not equipped to keep the user's body in balance. Moreover, the conventional exercise devices are not foldable to facilitate the storing and the shipping of the exercise devices.

SUMMARY OF THE INVENTION

The primary objective of the present invention is to provide an exercise device free from the drawbacks of the conventional exercise devices.

In keeping with the principle of the present invention, the foregoing objective of the present invention is attained by an exercise device consisting of a base, a grip unit, two treading members, a transmission mechanism, a driving member, and two damping members. The device is intended to build the muscles of waist and legs of a user of the device.

The foregoing objective, features and functions of the present invention will be more readily understood upon a thoughtful deliberation of the following detailed description of the present invention with reference to the accompanying drawings.

DETAILED DESCRIPTION OF THE INVENTION

Figure 1:
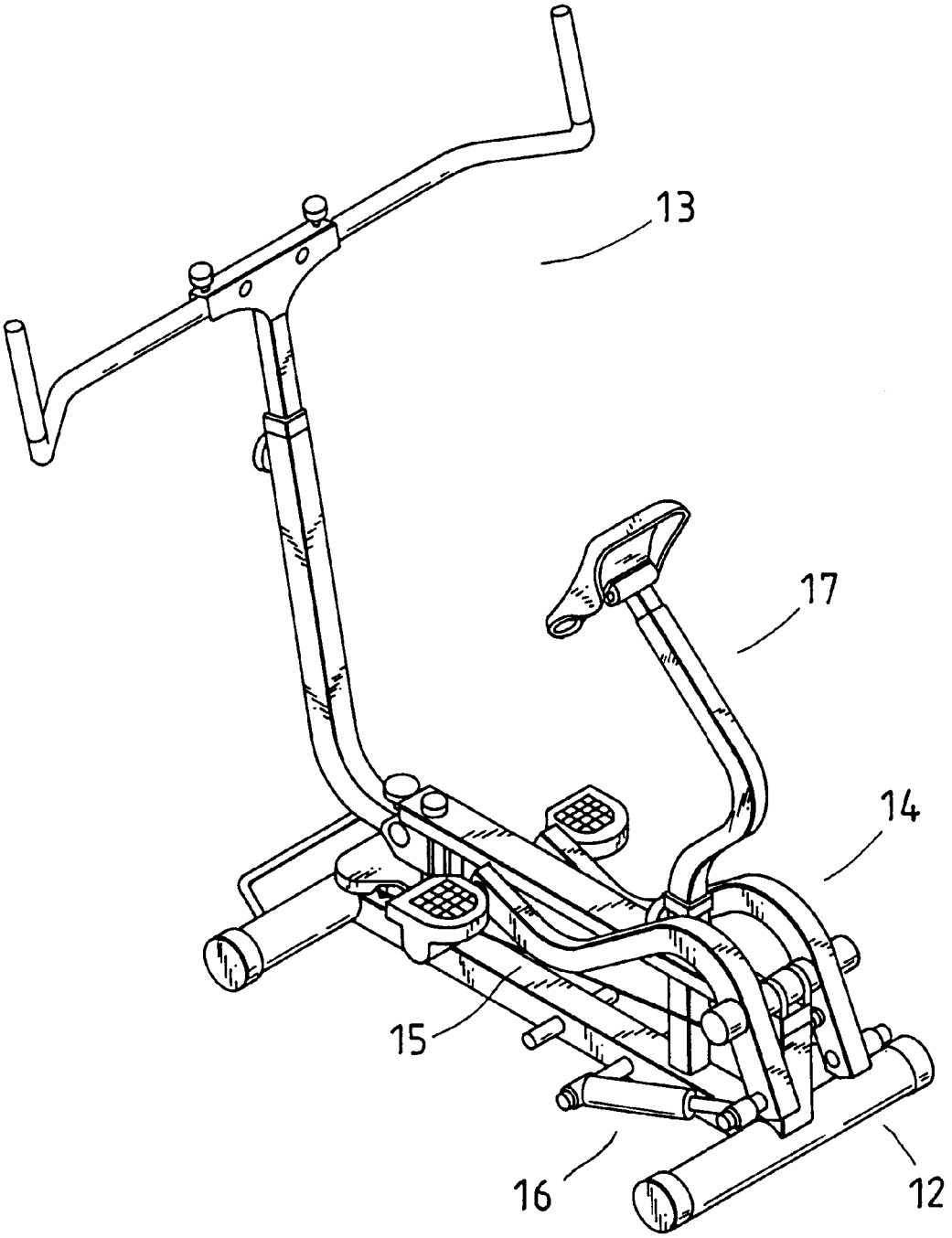
FIG. 1 shows a perspective view of the present invention.
Figure 2:
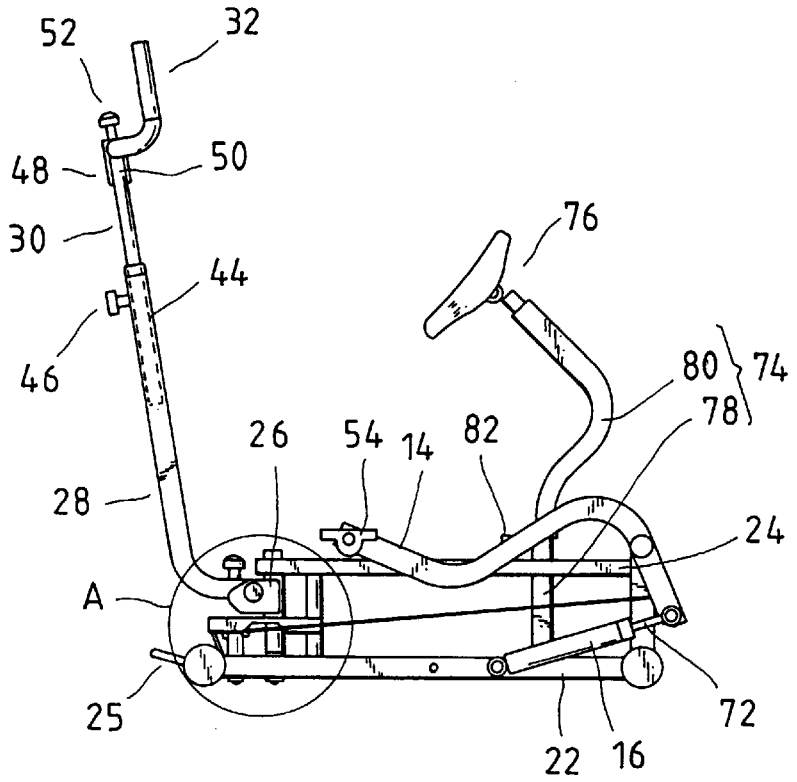
FIG. 2 shows a side view of the present invention.
Figure 3:
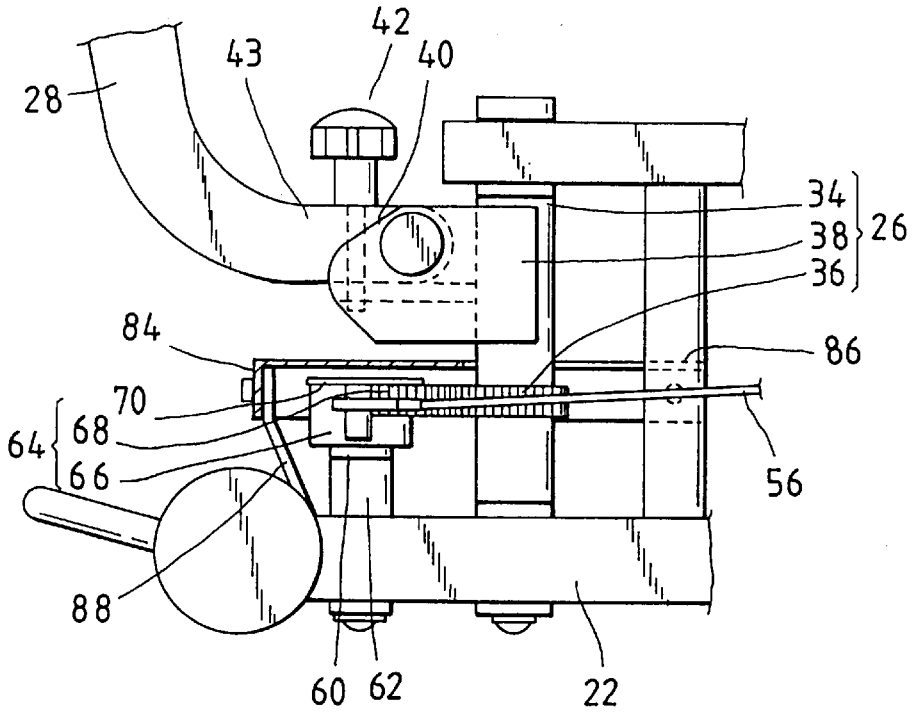
FIG. 3 shows a partial enlarged view of the present invention shown within circle A of FIG. 2.

As shown in FIGS. 1–3, an exercise device 10 embodied in the present invention is composed of the component parts which are described hereinafter.

A base 12 has an H-shaped seat portion 22, an upright support 24 mounted on the seat portion 22, a pull handle 25 fastened with a front end of the seat portion 22, a grip unit 13 rotatably mounted on a front end of the upright support 24, two treading members 14 fastened pivotally with a rear end of the upright support 24 and linked with the grip unit 13 by a transmission mechanism 15, two damping members 16 connected with the treading members 14 and the seat portion 22, and a support unit 17 mounted on the upright support 24 such that the support unit 17 is corresponding in location to the grip unit 13.

The grip unit 13 is composed of a rotary member 26, a bottom rod 28, a movable rod 30, and two handles 32. The rotary member 26 has a rod body 34 which is fastened pivotally between the front end of the upright support 24 and the seat portion 22. The rotary member 26 further has a connection portion 36 (a gear) which is mounted on the midsegment of the rod body 34, and a placing portion 38 mounted over the connection portion and provided with a receiving cell 40 in which a curved bottom end 43 of the bottom rod 28 is fastened securely by means of a fastening member 42. The bottom rod 28 is provided in the top end thereof with a receiving space 44 for accommodating the movable rod 30, which is provided with a plurality of locating holes (not shown in the drawings) arranged along the direction of the longitudinal axis of the movable rod. The movable rod 30 can be fastened with the bottom rod 28 at a predetermined level by a fastening member 46 engageable with any one of the locating holes. The movable rod 30 is provided at the top end thereof with a receiving seat 48 which is in turn provided with two placing spaces 50 in which the two grips 32 are fastened pivotally. The handles 32 are fastened respectively with the receiving seat 48 by a fastening bolt 52.

The two treading members 14 are fastened pivotally and respectively at the midsegment thereof with the top of the rear end of the upright support 24 and are provided respectively with a pedal 54 fastened therewith.

The transmission mechanism 15 consists of two transmission members 56 and a driving member 58. The transmission members 56 are fastened at one end thereof with the treading members 14 such that the transmission members 56 are fastened at another end thereof with two ends of the driving member 58. The driving member 58 comprises a base portion (a pivot) 60 which is fastened pivotally with a hollow seat body 62, a driving portion 64 having a flat plate 66 mounted on the base portion 60, a toothed portion 68 fastened with the flat plate 66 and engaged with the connection portion 36, and a connection portion 70 fastened with the flat plate 66 and the two transmission members 56.

Each of the two damping members 16 is a pneumatic cylinder and is connected at an output end 72 thereof with the bottom end of the treading member 14, and at another end thereof with the seat portion 22.

The support unit 17 consists of a support rod 74 and a pad 76 located on the top end of the support rod 74. The support rod 74 is fastened with an insertion rod 80 of a hollow fastening rod 78 by welding. The insertion rod 80 is fastened with the fastening rod 78 by a fastening member 82.

A protective shield 84 is located over the driving member 58 and the connection portion 36 such that two connection portions 86 of the protective shield 84 are fastened with the upright support 24 and the seat portion 22 by means of a strip 88 of the connection portion 86.

Figure 4:
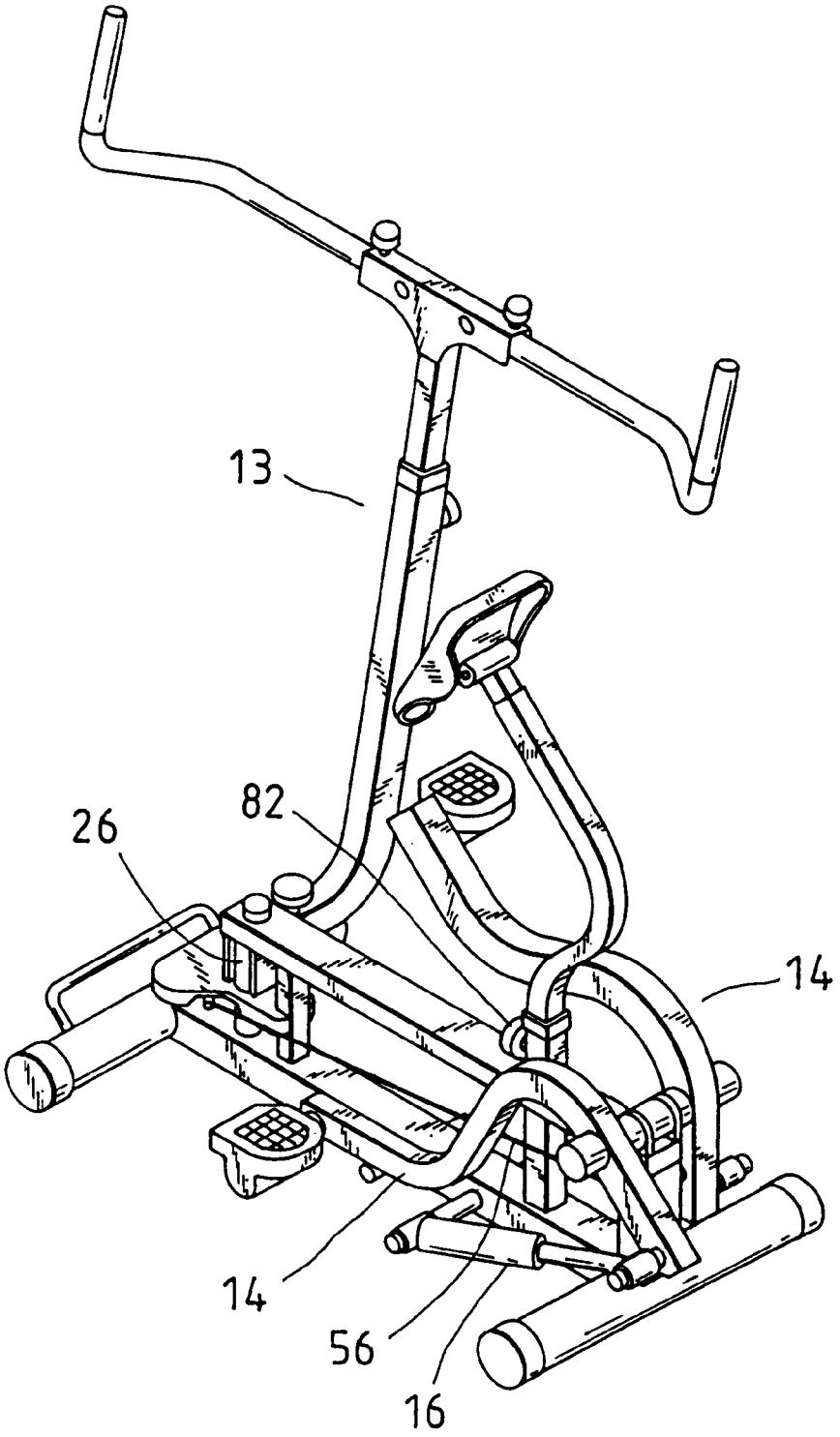
FIG. 4 shows a schematic view of the present invention at work.
Figure 5:
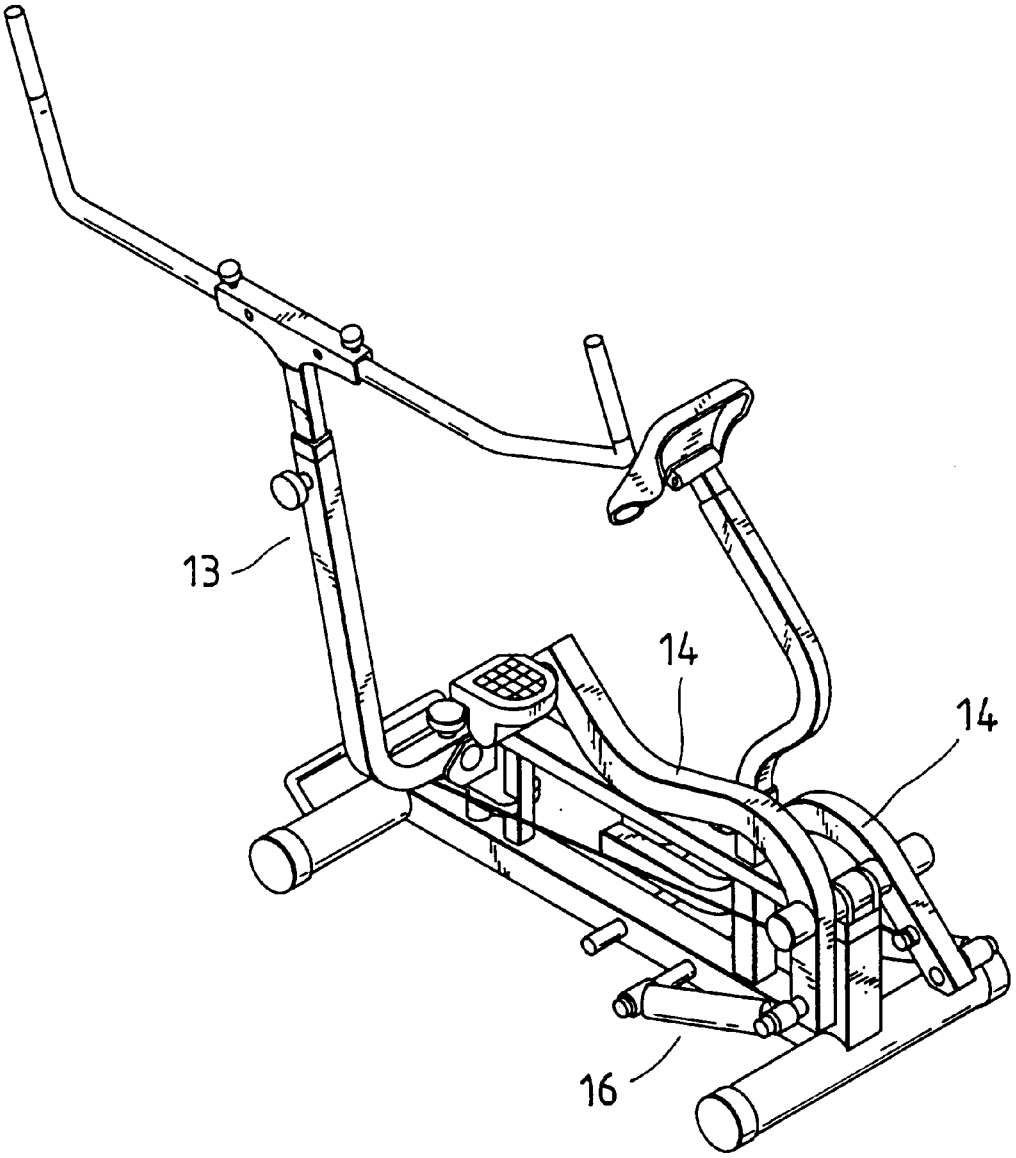
FIG. 5 shows another schematic view of the present invention at work.

As illustrated in FIG. 4, when one of the treading members 14 is pressed, the transmission member 56 is actuated to move backward so as to cause the driving member 58 to turn toward the left side, thereby causing the rotary member 26 to turn toward the right side. As a result, the grip unit 13 is caused to turn rightward. In the meantime, the right transmission member 56 is caused by the driving member 58 to move forward for actuating another one of the two treading members 14 to move upward. On the other hand, when another one of the two treading members 14 is pressed, as shown in FIG. 5, the right transmission member 56 is actuated to move backward so as to cause the driving member 58 to turn rightward, thereby causing the rotary member 26 to turn leftward. As a result, the grip unit 13 is caused to turn leftward. When an exerciser stands on the two pedals 58, with both hands holding the handles 32, to do a treading motion repeatedly, the waist of the exerciser can engage in a twisting motion, thanks to the swiveling grip unit 13. The repeated treading motion is brought about by both legs of the exerciser by overcoming the damping force of each of the two damping members 16. When the twisting motion is brought about repeatedly, the waist of the exerciser can lean against the pad 76 of the support unit 17 such that the body of the exerciser is kept in balance.

Figure 6:
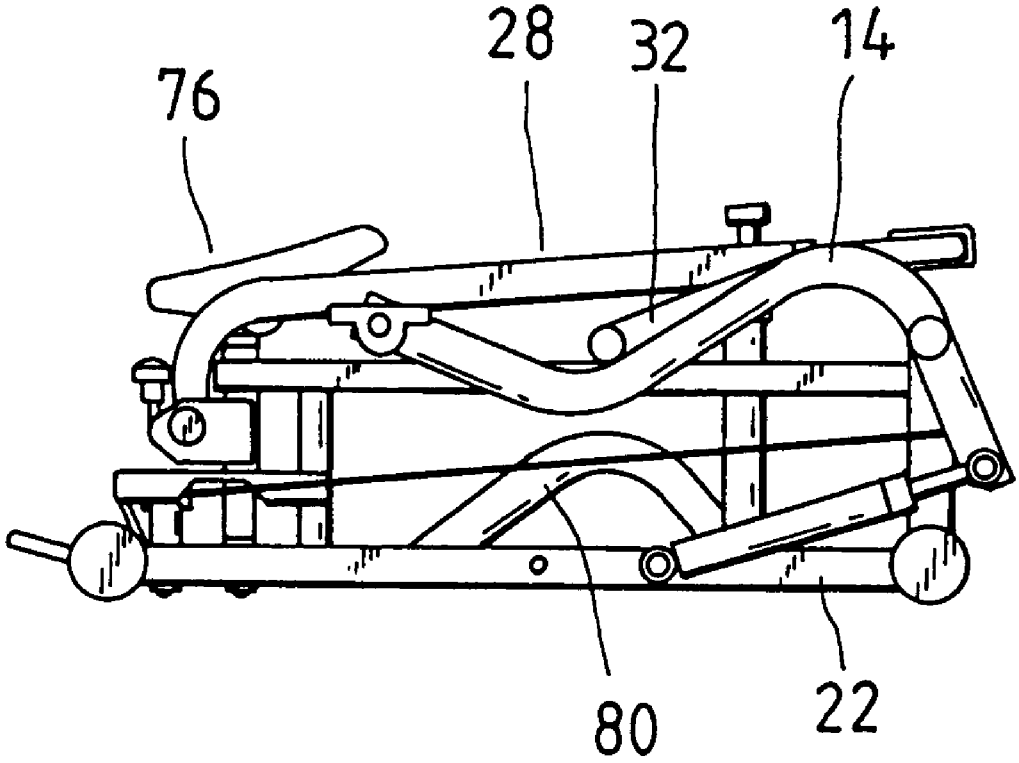
FIG. 6 shows a schematic view of the present invention in a folded state.

As shown in FIG. 6, the exercise device 10 of the present invention can be folded by loosening the fastening members 82, 42, and the fastening bolt 52 so as to enable the insertion rod 80 to be detached and to enable the bottom rod 28 to be placed on the upright support 24. In addition, the two handles 32 can be folded to locate in the two treading members 14.

What is claimed is:

1. An exercise device comprising:

a base having an upright support;

a grip unit mounted rotatably on one end of said upright support;

two treading members fastened pivotally with another end of said upright support and provided respectively with a pedal fastened therewith;

a transmission mechanism consisting of two transmission members fastened with said treading members, and a driving member fastening pivotally with said base, said grip unit, and said transmission members;

two damping members connected with said treading members and said base; and a support unit mounted on said upright support such that said support unit is corresponding in location to said grip unit;

wherein said grip unit consists of a rotary member fastened pivotally with said base, a bottom rod fastened with said rotary member and provided with a receiving space, a movable rod located extractably and retractably in said receiving space of said bottom rod, and two handles fastened with said movable rod;

wherein said rotary member has a rod body fastened pivotally with said base, a connection portion fastened with said rod body and said driving member, and a placing portion located on said connection portion for holding said bottom rod.

2. The exercise device as defined in claim 1, wherein said base has a seat portion; and wherein said upright support is mounted on said seat portion.

3. The exercise device as defined in claim 1, wherein said placing portion is provided with a receiving cell; and wherein said bottom rod is fastened at a bottom end thereof in said receiving cell of said placing portion by a fastening member.

4. The exercise device as defined in claim 1, wherein said connection portion is a gear.

5. The exercise device as defined in claim 1, wherein said movable rod is provided at a top end thereof with a receiving seat, said receiving seat provided with two placing spaces for holding one end of said handles.

6. The exercise device as defined in claim 5, wherein said one end of said handles is fastened pivotally in one of said two placing spaces such that said handles are fastened with said receiving seat by a fastening bolt.

7. The exercise device as defined in claim 1, wherein said driving member has a base portion, a driving portion mounted on said base portion and connected with said connection portion, and a connecting portion mounted on said base and connected with said transmission members.

8. The exercise device as defined in claim 7, wherein said driving portion has a toothed portion.

9. The exercise device as defined in claim 2, wherein said damping members are connected with said treading members and said seat portion of said base.

10. The exercise device as defined in claim 9, wherein said damping members are pneumatic cylinders.

11. The exercise device as defined in claim 1, wherein said support unit has a support rod which is mounted on said upright support and provided with a pad fastened therewith.

* * * * *